United States Patent [19]

Kipp

[11] 3,934,758

[45] Jan. 27, 1976

[54] REFRIGERATED BEVERAGE DISPENSER-MIXER

[76] Inventor: Frederick M. Kipp, 455 Beach Road, Fairfield, Conn. 06430

[22] Filed: Mar. 14, 1974

[21] Appl. No.: 451,025

[52] U.S. Cl. ..... 222/108; 222/131; 222/146 C; 222/528; 251/9; 62/161; 62/392; 259/108

[51] Int. Cl.[2] ..... B67D 5/62

[58] Field of Search ..... 222/146 R, 146 C, 54, 131, 222/183, 108, 63, 528, 529; 62/389, 391, 392, 377, 273, 280, 161; 221/150 B; 259/107, 108; 251/7, 9, 10

[56] References Cited

UNITED STATES PATENTS

| | | | |
|---|---|---|---|
| 455,392 | 7/1891 | Ellis | 251/10 |
| 2,030,291 | 2/1936 | Fuller | 62/377 X |
| 2,154,677 | 4/1939 | Hartman | 222/146 C X |
| 2,377,261 | 5/1945 | Norris | 222/529 X |
| 2,672,030 | 3/1954 | Schweller | 62/273 |
| 2,745,259 | 5/1956 | Saunders | 62/377 X |
| 2,745,260 | 5/1956 | Saunders | 62/377 |
| 2,797,560 | 7/1957 | Koolker et al. | 62/280 X |
| 3,045,869 | 7/1962 | Rodth et al. | 222/54 X |
| 3,149,471 | 9/1964 | Boehmer et al. | 62/389 X |
| 3,221,943 | 12/1965 | Anderson | 222/183 |
| 3,310,953 | 3/1967 | Rait | 222/146 R X |
| 3,445,039 | 5/1969 | Brodsky et al. | 222/146 R X |
| 3,612,126 | 10/1971 | Emmons et al. | 259/108 X |
| 3,664,643 | 5/1972 | Neve | 62/392 X |
| 3,811,294 | 5/1974 | Taylor | 222/146 C X |

*Primary Examiner*—Drayton E. Hoffman
*Assistant Examiner*—Charles A. Marmor
*Attorney, Agent, or Firm*—Mattern, Ware and Davis

[57] ABSTRACT

A beverage dispenser-mixer capable of storing, cooling, mixing and serving beverages incorporates a thermally insulated, open-ended refrigerating enclosure with inside walls composed of a thermally conductive material communicating with a refrigerating means. A beverage container with an open top incorporates a thermally insulated front plate that removably interfits with the inside walls of the refrigerating enclosure to form a mechanically and thermally sealed beverage storage compartment. The beverage container includes a fluid agitator that removably engages with an agitator motor within the enclosure for mixing or stirring beverages within the beverage container. The beverage container further incorporates a handle and a spigot with a pinch-type valve for dispensing beverages within it.

23 Claims, 12 Drawing Figures

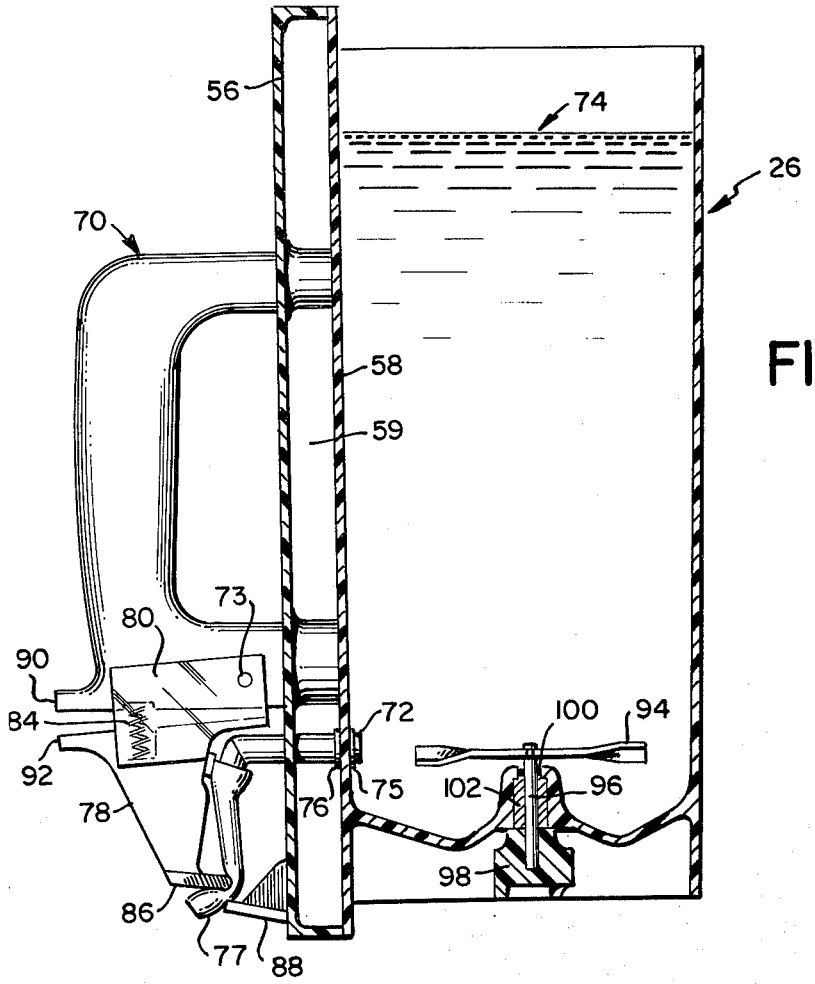
FIG. 6
FIG. 7
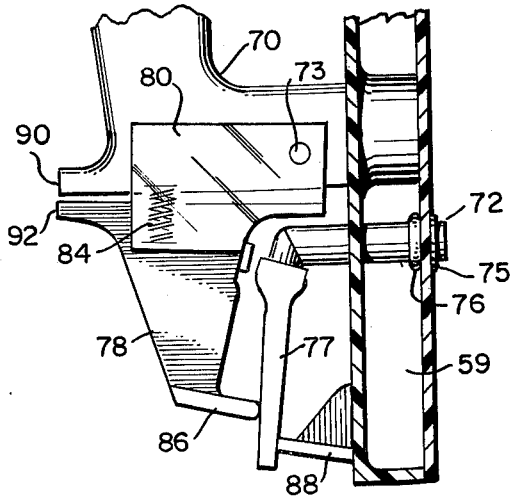
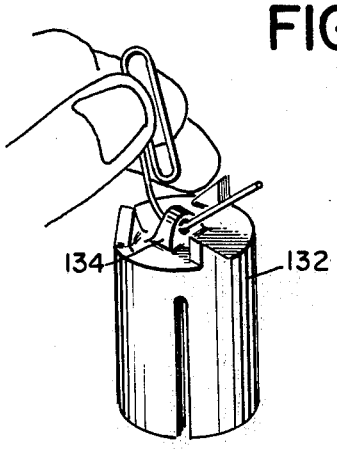
FIG. 8

HOUSEHOLD REFRIGERATOR VERSION
38
AGITATOR MOTOR
32
FAN MOTOR
124
66
110 VAC
60~
COUNTER TOP VERSION
28
THERMOELECTRIC REFRIGERATING DEVICE
OVERHEAT THERMOSTAT
138
136
D.C. POWER SUPPLY
OUTPUTS
34
36
38
AGITATOR MOTOR
66
124
32
FAN MOTOR
110 VAC
60~

REFRIGERATED BEVERAGE DISPENSER-MIXER

BACKGROUND OF THE INVENTION

This invention relates to a refrigerated beverage dispenser-mixer capable of stirring, mixing, cooling and dispensing beverages.

At the present time there exist several devices capable of dispensing beverages from a container that is cooled by some means. Thus, for instance, in U.S. Pat. No. 2,601,319 a device is disclosed wherein a large quantity of milk is stored in a container with a dispensing tube and valve. The device includes a refrigerated compartment wherein the milk container is placed. These devices, however, do not allow the dispensing of the liquid by removing the container from the refrigerated compartment and pouring from it. They also do not provide means for the agitation of the beverage while within the container.

The present invention, however, provides for easy removability of the beverage container while also incorporating a beverage agitator that is particularly adapted for reconstituting powdered beverages or frozen liquid concentrates with water.

The present invention includes a version in which the cooling of the beverage is performed by a self-contained thermoelectric refrigerating device. In this version the present invention may be placed on a counter top for easy access without the need of any additional refrigerating sources. Although U.S. Pat. No. 3,248,011 discloses a device utilizing a thermoelectric cooling device for the dispensing of a liquid, this invention neither utilizes a mixing device nor a removable container for dispensing of the liquid from without the refrigerating enclosure.

A second version of the present invention provides for the use of the device in conjunction with a standard refrigerator, whereby the device is mounted within a portion of the refrigerator door. In such a configuration the cooling air of the refrigerator is utilized to cool the beverage container. The beverage container is likewise removable from the refrigerator door and includes a fluid agitator for the mixing of reconstituted beverages.

The prior art devices for the dispensing of beverages from a standard refrigerator do not teach the removability of a beverage container nor the utilization of a fluid agitator. In U.S. Pat. No. 2,914,218 an apparatus is disclosed for the dispensing of liquids from a refrigerator. This invention, however, requires the dispensing to be performed at the refrigerator and does not allow the mixing or stirring of the beverage.

Although U.S. Pat. No. 3,476,295 discloses a beverage dispenser that is mounted within a refrigerator door, the beverage container is not easily removable from the door nor are agitating means included for mixing or stirring reconstituted beverages.

Therefore the present invention provides a novel apparatus for dispensing, mixing, refrigerating and storing household beverages. The invention eliminates the need for opening a refrigerator door every time a particular beverage is desired, thus eliminating a common waste of refrigerating energy while providing a convenient method of obtaining a desired beverage. By mixing the beverage within the present invention the need for transferring a beverage from a mixing device to a storing container is also eliminated. Moreover the present invention eliminates the need for a cover on the beverage container since when placed within the enclosure of the invention a mechanical seal is formed completely enclosing the contained beverage.

SUMMARY OF THE INVENTION

The refrigerated beverage dispenser-mixers of the present invention perform the storing, refrigerating, mixing and dispensing of beverages by means of an open-ended enclosure structure, a fluid container, a fluid dispenser, and a cooling mechanism.

More particularly, in the self-contained, counter top version, devices of the present invention include a housing structure and a thermoelectric refrigerating device. In this version the outer walls of the refrigerated enclosure structure are formed from a thermal insulating material of approximately one inch thickness. The inner walls of the enclosure structure are formed from a thermally conductive material, wherein a portion of this wall is thermally connected to the thermoelectric refrigerating device. Heat of the thermally conductive wall is thus "pumped" via the thermoelectric refrigerating device to a region of this device of relatively high temperature. A fan located within a housing surrounding the refrigerated enclosure structure forces air over this high temperature portion of the thermoelectric refrigerating device, expelling this air through orifices located in the housing structure.

The beverage container includes a closure plate formed from a transparent thermal insulating material which allows the user to observe the beverage therein. A handle on the beverage container provides easy manual movement of the beverage container. The beverage container is capable of fitting within the space formed by the refrigerated enclosure structure, and when in this space the closure plate forms a thermal and mechanical seal in conjunction with the closure structure so as to completely enclose the beverage contained in the beverage container. A limit switch arm extension passes through an orifice in the inner and outer refrigerated enclosure walls and protrudes into the space created by the refrigerated enclosure structure. The outer wall of the beverage container engages the limit switch extension arm when the container is within the space formed by the enclosure structure. When so engaged the limit switch activates the thermoelectric refrigerating device and thus cools the contents of the beverage container. When the beverage container is removed from the enclosure space the limit switch de-activates the thermoelectric device, thereby minimizing heat transfer to the inner thermally conductive walls from the outside environment.

The beverage container does not have or need a lid since the inner walls of the enclosure structure provide a mechanical seal for the beverage container when the container is within the enclosure structure.

The beverage container further incorporates a fluid agitator mechanically affixed to the bottom wall of the beverage container. The agitator provides for the easy mixing of beverages, especially beverages prepared from reconstituted powders, such as powdered milk or frozen liquid concentrate, such as frozen orange juice.

The fluid agitator incorporates an upper drive cog. This drive cog is mechanically engaged to a lower motor drive cog placed within the lower wall portion of the enclosure structure. This lower drive cog connects to a motor drive mechanism and a mixer drive actuator arm which mechanically raises the lower drive cog so as to engage with the upper drive cog. The raising of the mixer drive actuator arm also activates the motor drive mechanism so that rotational energy is imparted to the lower drive cog.

An orifice is provided through a portion of the bottom wall of the thermally conductive material and the enclosure structure so as to provide a drainage means for any accumulated condensation on the thermally conductive wall. A flexible tubing is placed within the orifice and terminates in a drip tray within the housing structure. The exhaust air passing over the thermoelectric refrigerating device similarly passes over the drip tray before exiting from the housing structure and thereby evaporates the accumulated condensation.

Devices of the household refrigerator version of the present invention are mounted within a portion of the household refrigerator door. These devices utilize the refrigerated air within the refrigerator to cool the inner thermally conductive walls of the enclosure structure. The refrigerated enclosure structure of this version incorporates an air space or plenum between the thermally conductive walls and the thermally insulated outer walls of the refrigerated enclosure structure. An orifice is located in one section of the outer walls whereby a fan mounted over this orifice forces refrigerated air into the plenum generated between the inner and outer walls of the enclosure structure. A series of air vent holes located at the upper and lower portions of this plenum provide for the escape of the refrigerated air back to the refrigerator compartment after passing over substantially the entire area of the inner thermally conductive walls; thereby providing for the efficient cooling of these walls and of the beverage container when placed within these walls.

A limit switch arm extension passes through an orifice in the inner and outer refrigerated enclosure walls and protrudes into the space created by the refrigerated enclosure structure. The outer wall of the beverage container engages the limit switch extension arm when the container is within the space formed by the refrigerated enclosure. When so engaged the limit switch activates the fan so as to provide refrigerated air throughout the plenum. When the beverage container is removed from the refrigerated enclosure space the limit switch de-activates the fan, thereby reducing any heat loss from the inner thermally conductive walls to the outside environment.

The remaining structure and operation of the refrigerated version of the present invention is identical to the self-contained counter top version.

OBJECTS OF THE INVENTION

Therefore it is a principal object of the present invention to provide a refrigerated beverage dispenser-mixer that is capable of storing, mixing, cooling, and dispensing a desired beverage.

An additional object of the present invention is to provide a beverage container that removably interfits with a refrigerated enclosure to form a mechanical seal therewith.

Another object of the present invention is to provide a thermal seal around the beverage container of the present device when the beverage container is within the refrigerated enclosure structure of the present invention.

A further object of the present invention is to provide a beverage container with a manual dispensing spigot for dispensing a desired beverage from the beverage container, without disturbing the mechanical and thermal seals of the invention.

A further object of the present invention is to provide a beverage container with a open top so as to allow pouring a desired beverage to or from the beverage container.

An additional object of the present invention is to provide a beverage agitator for mixing, stirring, or reconstituting a desired beverage which does not disturb the mechanical and thermal seals formed by the present invention.

A further object of the present invention is to provide a counter top version of the present invention incorporating a thermoelectric refrigerating device.

A further object of the present invention is to provide means for minimizing the cooling loss of the present invention when the beverage container is removed from the refrigerated enclosure structure.

An additional object of the present invention is to provide a means for collecting and evaporating any condensation formed within the refrigerated enclosure structure of the present device.

A further object of the present invention is to provide a refrigerated beverage dispenser-mixer that is easily cleaned.

An additional object of the present invention is to provide a beverage container that is immersible in water for easy and efficient cleaning.

Another object of the present invention is to provide a refrigerated beverage dispenser-mixer that is inexpensive to construct and repair.

Other objects of the invention will in part be obvious and will in part appear hereinafter.

THE DRAWINGS

FIG. 6 is a cross-sectional side elevational view of the beverage container taken along line 6—6 of FIG. 3 showing the dispensing spigot tubing in the closed position.

FIG. 7 is an enlarged cross-sectional side view of a portion of the beverage container of FIG. 6 showing the dispensing spigot tubing in the open position.

FIG. 8 is a perspective view of the lower drive cog of the beverage agitator.

The same reference numbers refer to the same elements throughout the several views of the drawings.

DETAILED DESCRIPTION

Figure 1:
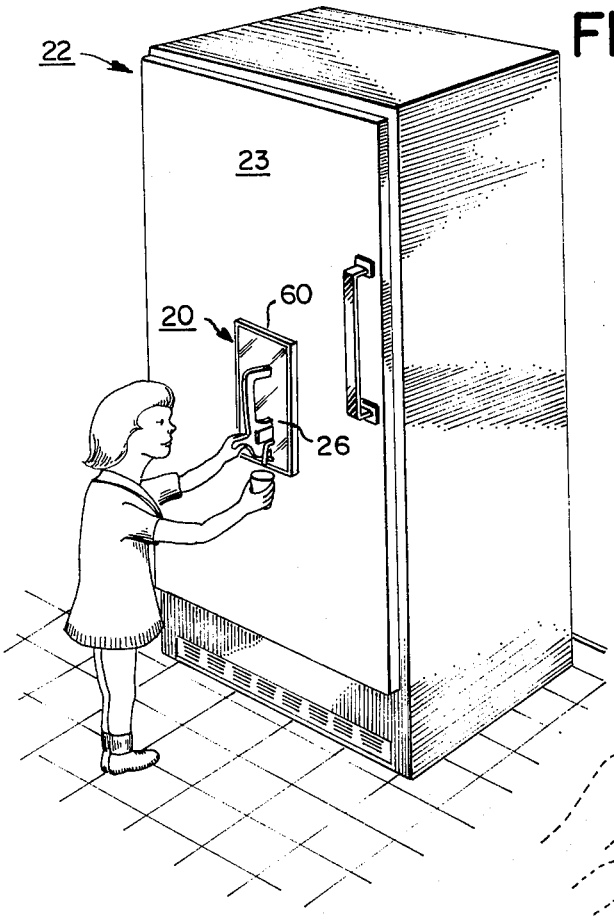
FIG. 1 is a perspective view of the household refrigerator version of the present invention showing a child dispensing a beverage from the invention.
Figure 2:
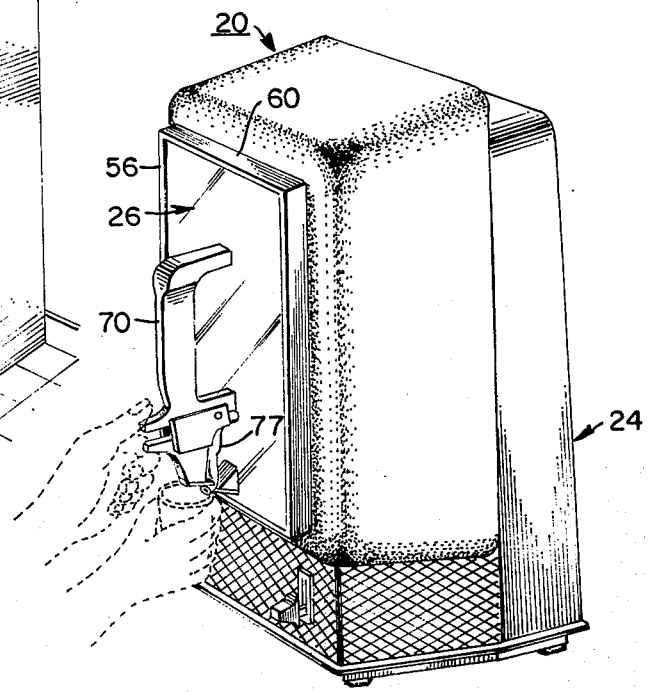
FIG. 2 is a perspective view of the counter top version of the present invention.
Figure 3:
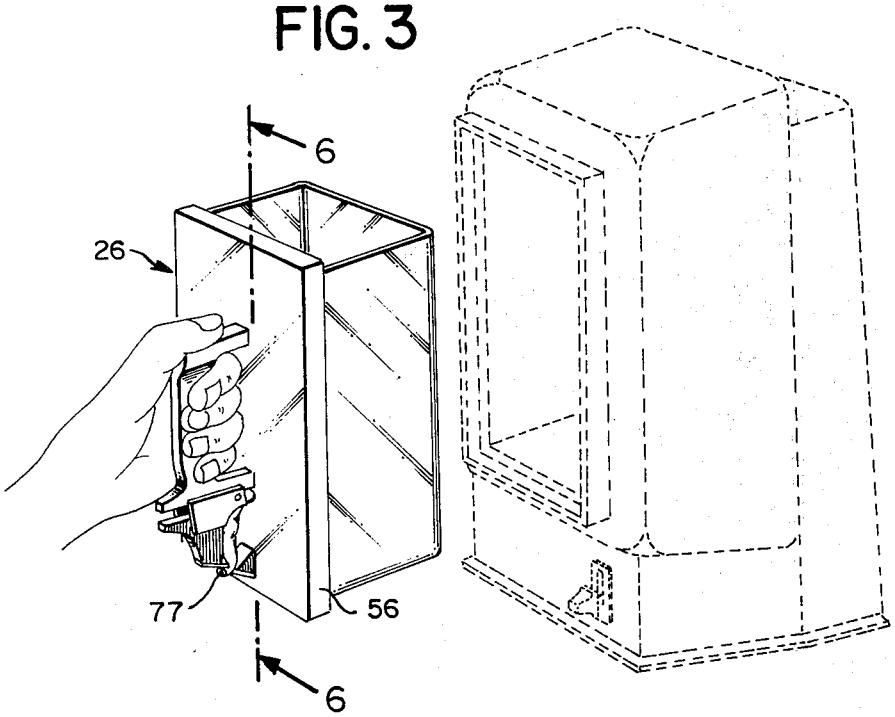
FIG. 3 is a perspective view of a beverage container of the present invention showing a dotted figure of the counter top version of FIG. 2.

As can best be seen in FIGS. 1 and 2 a refrigerated beverage dispenser-mixer 20 of the present invention may be incorporated in a household refrigerator 22 or may be placed in a counter top housing 24. As best seen in FIG. 3 both the household refrigerator version and the counter top version of the present invention use an identical beverage dispenser 26 for the storing, mixing and dispensing of a desired beverage.

Figure 5:
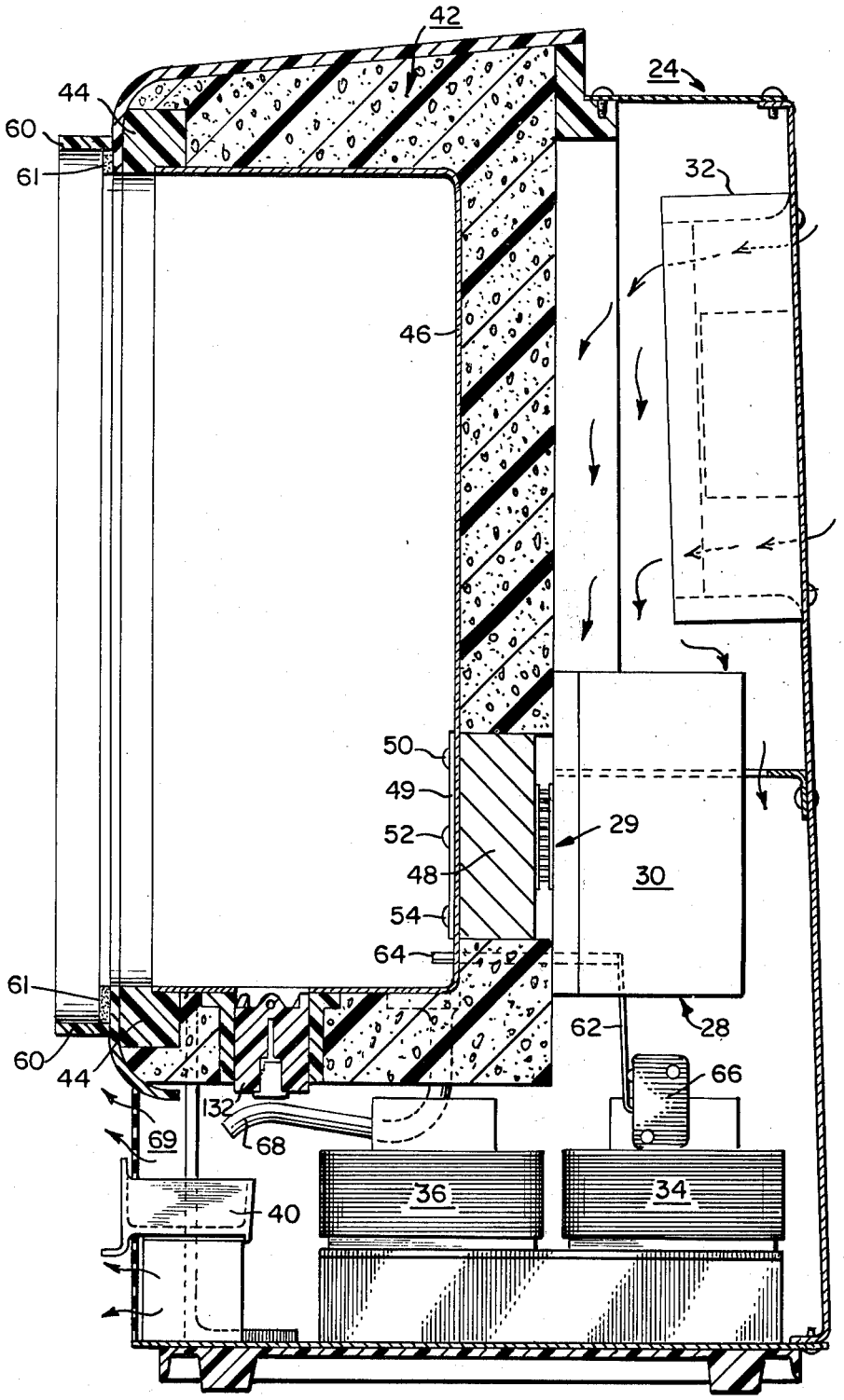
FIG. 5 is a side elevational view of the counter top version of the present invention taken along line 5—5 of FIG. 4.

As best seen in FIG. 5 the counter top version of the present invention utilizes a thermoelectric refrigerating device 28 to provide cooling power. The thermoelectric refrigerating device operates on a reverse thermocouple effect whereby cooling is obtained at a junction of two dissimilar materials when direct current is passed through their junction. A group of these junctions 29 provide the heat pumping in thermoelectric refrigerating device 28. Such devices are manufactured by Ohio Semi-Conductors, Columbus, Ohio and also by Materials Electronic Products Corporation of Trenton, N.J.. These devices are advantageous in a counter top version of the present invention since no moving parts are present in the thermoelectric device and also because a compressor is not needed to provide cooling as is necessary in conventional refrigerating devices. It should be noted however that absorption type cooling units, such as the devices manufactured by Bernzomatic Corporation, Rochester, N.Y., may be used instead of the thermoelectric device.

The warmer portion 30 of the thermoelectric device is cooled by the passage of air from fan 32. The air passing over warmer portion 30 proceeds to pass over transformers 34 and 36 as well as agitator motor 38 (see FIG. 4). The cooling air then passes over drip tray 40 and exits from counter top housing 24.

The counter top version of the present invention includes a refrigerating enclosure structure 42 with five sides forming a generally box-like space. The volume of this space is approximately one-one hundredth the volume of a standard refrigerator. The refrigerating enclosure is composed of a thermal insulating material, preferably one inch thick foamed polyurethane, so as to minimize the transfer of heat from outside the device when beverage container 26 is placed within the box-like space. Refrigerating enclosure 42 fits within housing 24 and front frame 44 via physical contact against these two parts of the invention.

Refrigerating enclosure structure 42 includes an inner liner 46 constructed from a thermally conductive material, preferably 0.063 inch thick type No. 1100-0 aluminum sheet.

The cold portion 48 of the thermoelectric refrigerating device 28 mechanically abuts a portion of inner liner 46 and is fastened thereto via thermally conductive plate 49 (preferably aluminum) and machine screws 50, 52, and 54. Thus the removal of heat from inner liner 46 is conducted through cold portion 48 and thereby to warmer portion 30 where it is removed from housing 24.

As best seen in FIG. 6, beverage container 26 is an open-topped container with a closure plate 56 integrally mounted to its frontal wall 58. An inner chamber 59 is thus formed between the closure plate 56 and the frontal wall 58 providing a thermal insulating front portion to the beverage container.

As best seen in FIGS. 2 and 5, when beverage container 26 is placed within housing 24, the frontal wall 58 forms a mechanical seal with seal gasket 61, preferably made of foamed rubber. A substantial lid is formed by the top portion of inner liner 46 and the top of beverage container 26. Thus a beverage within beverage container 26 radiates, conducts and convects heat to inner liner 46 whereby the heat is removed by thermoelectric refrigerating device 28. Due to the exceptional thermal insulating properties of refrigerating enclosure 42 and closure plate 56 in conjunction with closure plate frame 60 and seal gasket 61, the present invention needs relatively little cooling power from thermoelectric device 28 in order to provide the proper cooling to any beverage within the beverage container 26.

As best seen in FIG. 5, when beverage container 26 is removed from refrigerating enclosure structure 42, spring actuator arm 62 causes push rod 64 to longitudinally protrude into the space formed by the refrigerating enclosure. At this point limit switch 66 electrically opens, stopping the flow of electrical current into transformers 34 and 36; and thus removing electromotive power to thermoelectric refrigerating device 28 (see FIG. 10). When beverage container 26 is placed within refrigerating enclosure 42, push rod 64 causes spring actuator arm 62 to close limit switch 66 thereby supplying electromotive power to thermoelectric refrigerating device 28. Thus the present invention eliminates the escape of cooling power to the outside world when the beverage container is not within the refrigerating enclosure and additionally allows the inner liner 46 to defrost at such times so as to eliminate any ice buildup.

Any water or other fluid that may exist on inner liner 46 is removed by drain tube 68 into drip tray 40. Any liquid deposited in drip tray 40 is evaporated by the passage of air over the drip tray due to fan 32 and inner plenum 69 formed by counter top housing 24.

As best seen in FIG. 6 the beverage container 26 utilizes a handle 70 for easy manual movement. The beverage container also includes a spigot pipe 72 that protrudes through frontal wall 58 and closure plate 56 so as to allow a substantial portion of a beverage 74 to be able to pass through the spigot pipe by means of gravity flow. Gaskets 75 and 76 prevent any beverage from entering inner chamber 59. Spigot tubing 77, preferably constructed from a silicone elastomer, fits over one end of spigot pipe 72. The remainder of spigot tubing 77 protrudes substantially downward from spigot pipe 72 so as to allow the flow of beverage 74 from beverage container 26 to be in a substantially downward direction.

As best seen in FIGS. 6 and 7 a spigot clamp arm 78 is attached to a brace 80 that pivotally interconnects with handle 70 via roll pin 73. Compression spring 84 normally biases spigot clamp arm 78 away from handle 70 causing a lower finger 86 of the spigot clamp arm to impinge on spigot tubing 77 whereby the spigot tubing is crimped at a point between the lower finger 86 and a finger portion of spigot anvil 88. This crimping of spigot tubing 77 prevents the escape of beverage 74 from the beverage container 26.

As best seen in FIG. 7, when manual actuating force is applied to handle finger 90 and spigot clamp arm finger 92, spigot clamp arm 78 pivots away from spigot anvil 88 allowing spigot tubing 77 to open to its relaxed position, thus allowing beverage 74 to flow from beverage container 26. It is thus apparent that the above method of dispensing a beverage from the beverage container is extremely sanitary since no moving parts come in contact with the beverage. This method also prevents outside contaminates from entering the dispensing means.

As best seen in FIG. 6, beverage container 26 includes means for mixing, stirring or agitating beverages within the container. In particular, beverages prepared from a reconstituted powder such as powdered milk and powdered breakfast drinks require that the powder be thoroughly dissolved in water. Such thorough mixing and stirring is readily obtainable in the present invention. More particularly, beverage container 26 includes an agitator blade 94 perpendicularly connected to a shaft 96. The shaft passes through the bottom wall of the beverage container 26 and terminates in upper drive cog 98. The beverage 74 within beverage container 26 is prevented from passing through the orifice in the bottom wall of the beverage container by seal ring 100 through which shaft 96 passes. The shaft also passes through bearing 102 to minimize frictional wear as well as vibrations when rotational energy is imparted to the shaft.

Figure 4:
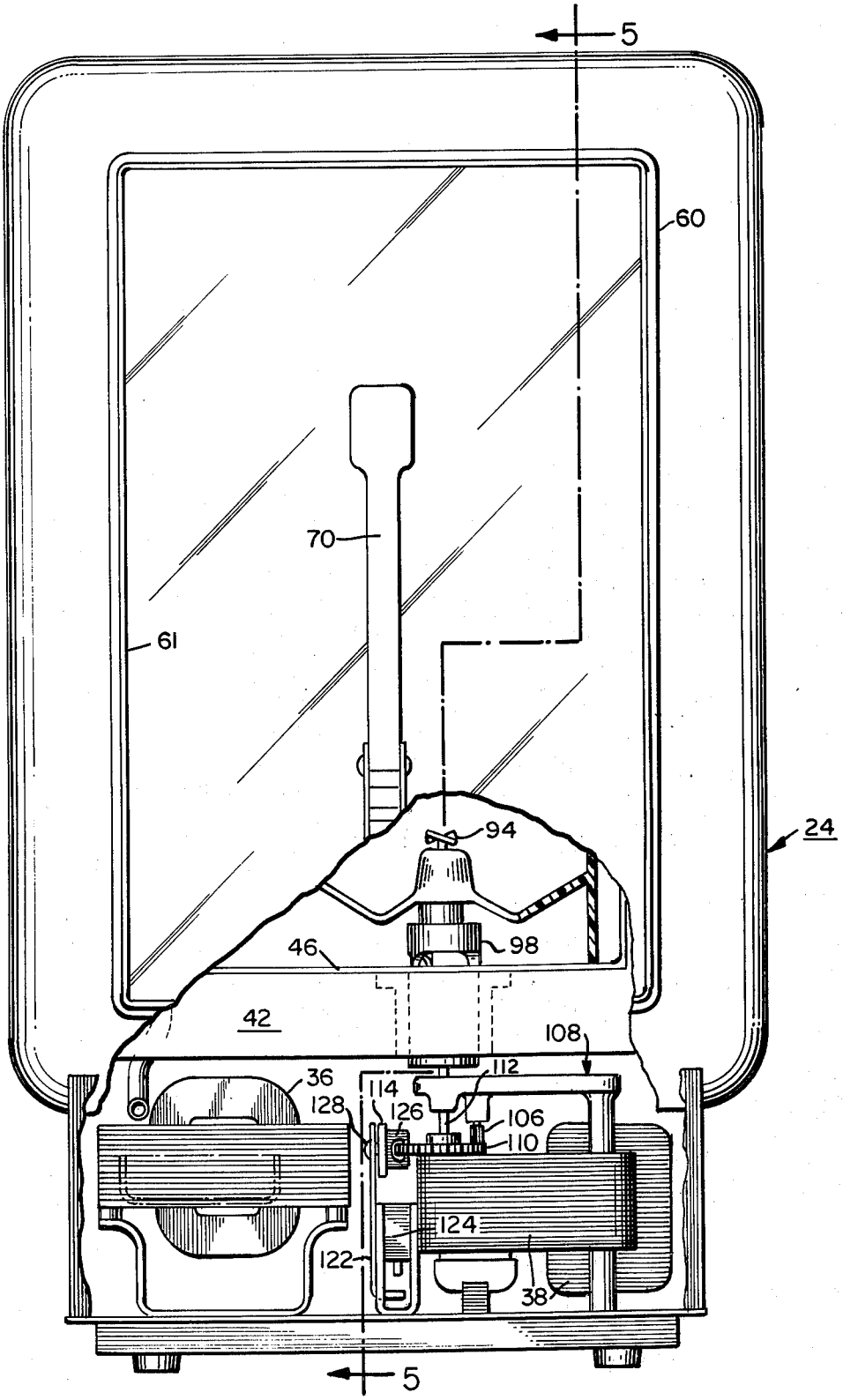
FIG. 4 is a front elevational view of the counter top version of the present invention with a section cut away showing the beverage agitator mechanism.
Figure 9:
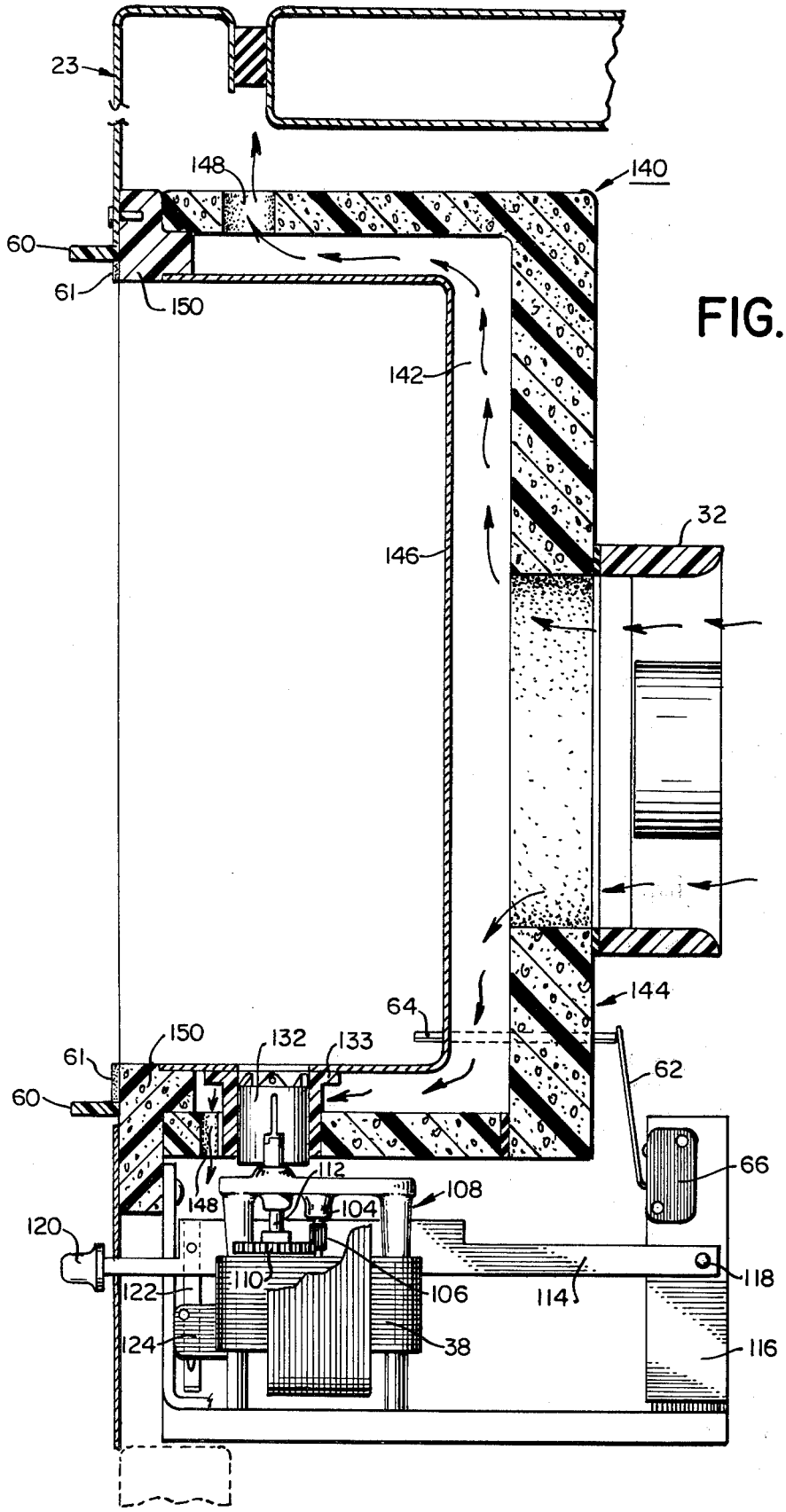
FIG. 9 is a cross-sectional side elevational view of the household refrigerator version of the present invention.

As best seen in FIGS. 4, 6, and 9, the rotational energy that is imparted to shaft 96 is generated by agitator motor 38. More particularly, motor 38 has a shaft 104 whereon a motor shaft gear 106 is formed. The shaft 104 terminates in motor housing 108. A sliding gear 110 engages with motor shaft gear 106 and is mounted on a slide shaft 112. An agitator actuator arm 114 pivots at one end on a mounting strip 116 via pin 118. The other end of agitator actuator arm 114 protrudes through housing 24. A knob 120 fits over the exposed end of agitator actuator arm 114 so as to provide easy manual movement of the actuator arm. Housing 24 is slotted where agitator actuator arm 114 protrudes so as to allow the actuator arm to be manually lifted.

The agitator actuator arm 114 is connected to a switch actuator arm 122. When the agitator actuator arm is lifted, switch actuator arm 122 engages with limit switch 124 causing motor 38 to be energized.

Lifting agitator actuator arm 114 also causes a sliding gear actuator 126, mounted to agitator actuator arm 114 via machine screw 128, to lift sliding gear 110. The sliding gear actuator is preferably made from Teflon so as to impart minimal frictional wear to sliding gear 110. Sliding gear 110 is attached to slide shaft 112 which after passing through housing 108, terminates with lower drive cog 132. Thus when agitator actuator arm 114 is lifted, lower drive cog 132 engages with upper drive cog 98 and thus imparts rotational energy to agitator blades 94. Lower drive cog fits within lower drive cog bearing 133 so as to minimize frictional wear and to properly position the drive cog.

As is best seen in FIG. 8 lower drive cog 132 includes a perforated boss 134 to provide for the easy removal of the lower drive cog from slide shaft 112 when beverage container 126 is not within refrigerating enclosure 42. Thus any beverage spillage or other foreign matter which may come in contact with the lower drive cog may be easily cleaned after such removal.

Figures 10, 11:
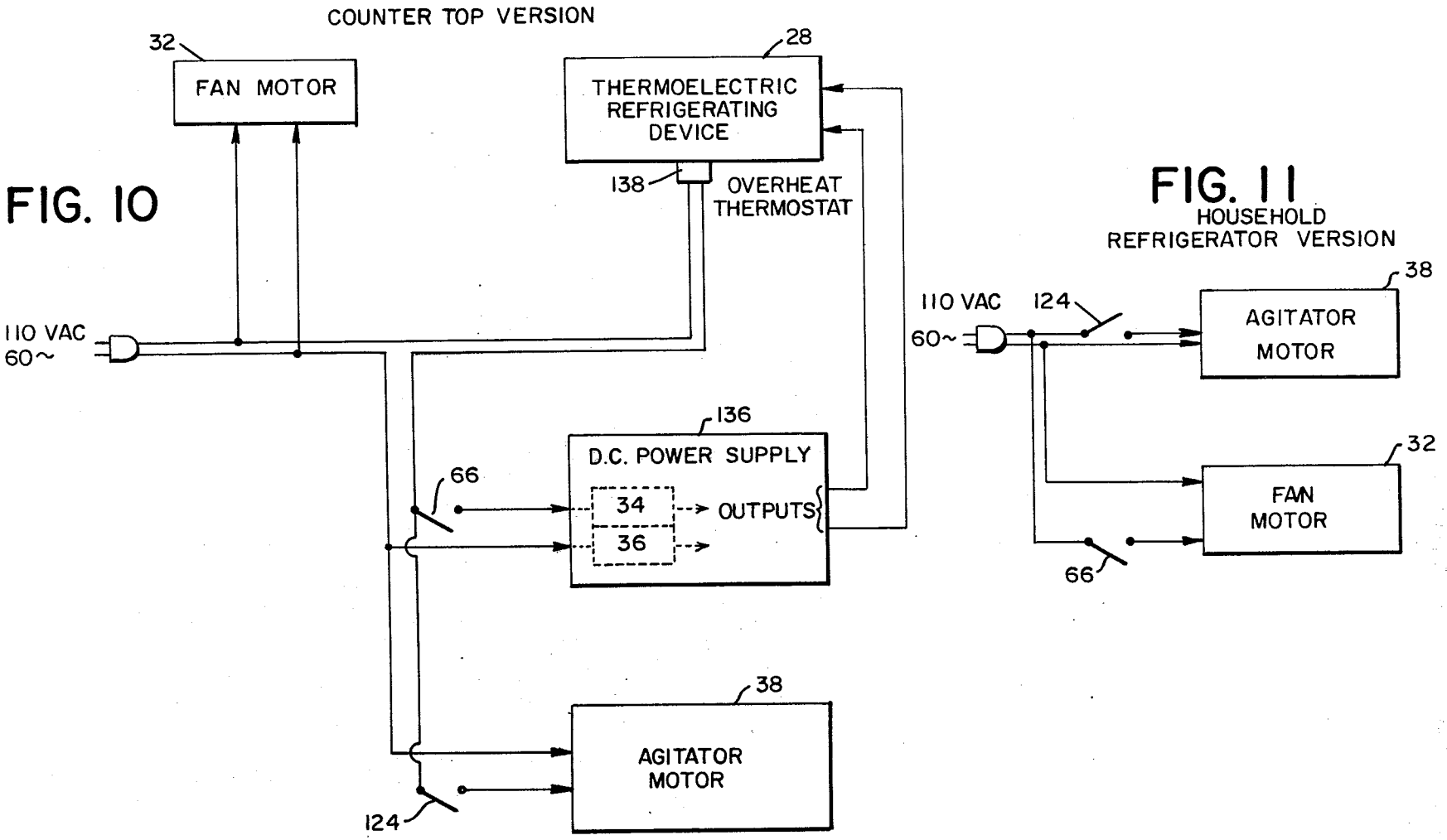
FIG. 10 is a schematic diagram of the counter top version of the present invention.
FIG. 11 is a schematic diagram of the household refrigerator version of the present invention.

The electrical connections in the counter top version of the present invention are best seen in FIG. 10. Thus fan motor 32 is energized whenever refrigerated beverage dispenser-mixer 20 is plugged in. The direct current power supply 136 is utilized to convert the 110 VAC to +3 VDC at 10.5 amps so as to properly energize thermoelectric refrigerating device 28. The direct current power supply 136 is energized whenever limit switch 66 is in the closed position; that is, whenever the beverage container 26 is within the refrigerating enclosure 42. Likewise, agitator motor 38 is energized whenever limit switch 124 is in the closed position; that is, whenever agitator actuator arm 114 is lifted.

An overheat thermostat 138 is mounted on thermoelectric device 28 which electrically opens whenever the thermoelectric refrigerating device exceeds a predetermined temperature. At such times both the direct current power supply 136 and the agitator motor 38 may not be activated regardless of the states of limit switches 66 and 124. The fan motor 32 however, is not de-energized if overheat thermostat 138 opens since it is preferably desired to continue the cooling of the thermoelectric refrigerating device whenever an overheat condition exists.

As best seen in FIG. 1, in the household refrigerator version of the present invention an identical beverage container 26 is used as described with respect to the counter top version of the present invention. Similarly, as seen in FIGS. 4 and 9, the agitator mechanisms used in the counter top version are also used in the household refrigerator version of the present invention. It is therefore noted that the same reference numbers refer to the same elements throughout the several views of the drawings.

As best seen in FIG. 9, the major differences between the household refrigerator version and the counter top version of the present invention rests in the apparatus used to effectively cool the contents of the beverage container. More particularly, the household refrigerated version of the present invention incorporates a refrigerating enclosure structure 140 creating an air plenum 142. The outer portion 144 of refrigerating enclosure 140 is made from a thermal insulating material, preferably a self-surfacing foamed polyurethane plastic. An inner liner 146 of the refrigerating enclosure 140 is composed of a thermally conductive material, preferably 0.063 inch thick type No. 1100-0 aluminum. Fan 32 causes refrigerated air within the household refrigerator to enter the air plenum 142 thus cooling inner liner 146. The outer portion of 144 of the refrigerating enclosure 140 includes a multiplicity of exit ports 148 which allow the escape of air within the air plenum 142 after traveling over substantially all of the inner liner 146.

The household refrigerator version of the present invention utilizes an identical beverage container sensing means; that is push rod 64, spring actuator arm 62 and limit switch 66, so as to de-energize fan 32 whenever beverage container 26 is not within refrigerating enclosure 140. Thus only a nominal amount of heat loss occurs when the beverage container is not within the refrigerating enclosure since the shape of air plenum 142 is particularly opposed to air convection when fan 32 is not activated.

As best seen in FIGS. 1 and 9, the household refrigerator version of the present invention is mounted within a portion of a household refrigerator door 23 via front frame 150. A closure plate frame 60 and a seal gasket 61 are identical to the closure plate frame and seal gasket disclosed in the counter top version of the present invention. In addition, the front frame 150 is mounted to the refrigerator door 23 so as to provide pressure fitting areas for refrigerating enclosure 140.

As best seen in FIG. 11 the household refrigerator version of the present invention utilizes a relatively simple electrical wiring schematic. More particularly, when beverage container 26 is removed from refrigerating enclosure 140, limit switch 66 opens thereby de-energizing fan 32. Likewise, when agitator actuator arm 114 is manually lifted limit switch 124 is closed thereby energizing agitator motor 38.

Figure 12:
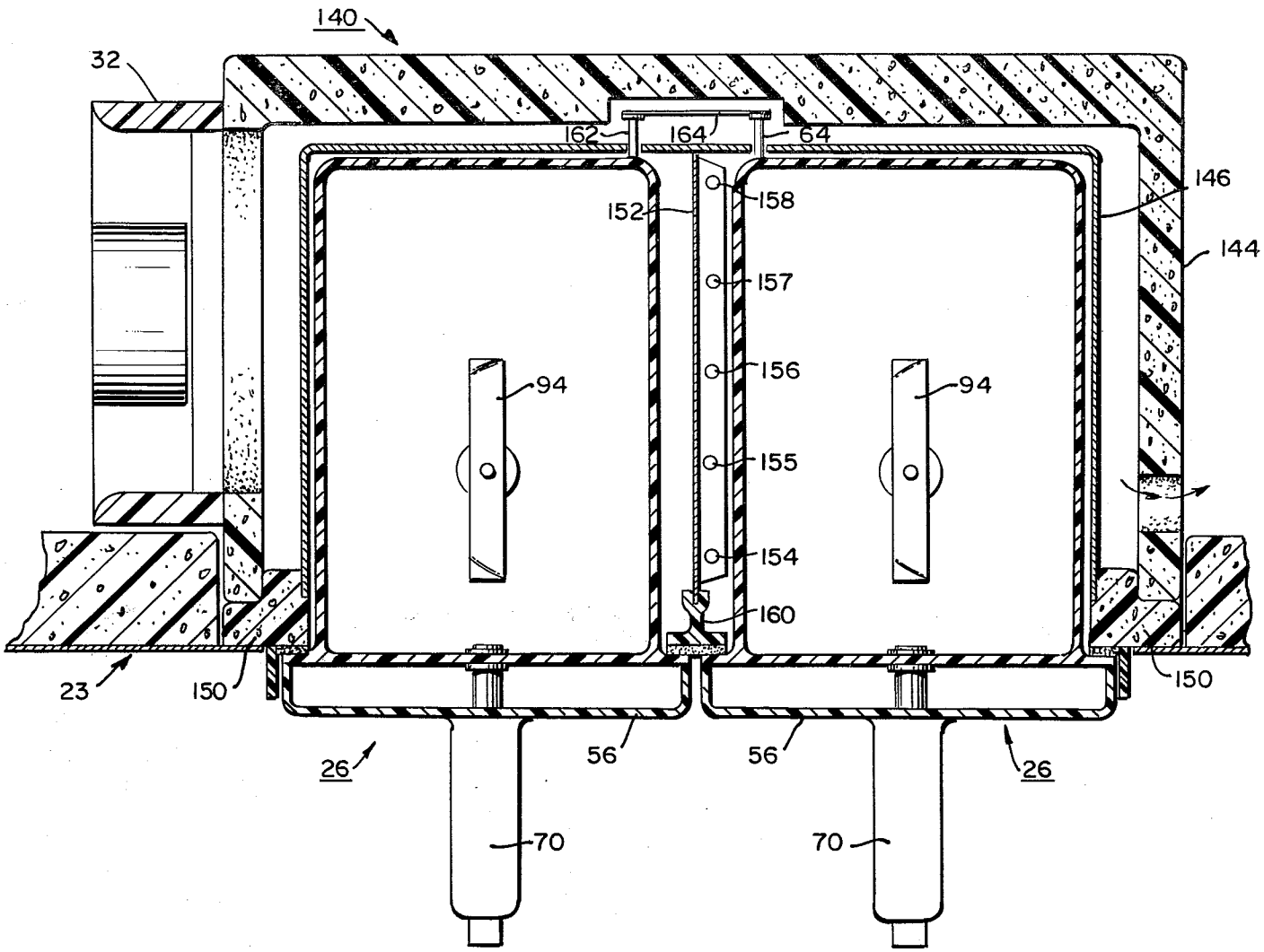
FIG. 12 is a cross-sectional top view of the household refrigerator version of the present invention showing two beverage containers.

As best seen in FIG. 12, it is apparent that more than one beverage container 26 may be used in either the counter top version or the household refrigerator version of the present invention. The only additions necessary for use of multiple beverage containers 26 are a refrigerating enclosure partition 152, preferably formed from a thermally conductive material, which is mechanically and thermally attached to the inner liner 146 of the household refrigerator version of the present invention. Refrigerating enclosure partition 152 is attached to inner liner 146 via means of machine screws 154, 155, 156, 157 and 158. In addition, refrigerating enclosure partition 152 fits within a groove of front frame partition 160 which vertically spans the space formed by refrigerating enclosure structure 140.

An additional push rod 162 is mechanically connected to push rod 64 via metal strip 164. Thus fan 32 is de-energized only when both beverage containers are removed from refrigerating enclosure structure 140.

The remaining structure of the multiple beverage container configuration of the present invention is identical to the structures defined in either the counter top version or the household version of the present invention.

It is obvious to one skilled in the art that more than two beverage containers may be utilized in the present invention. Additionally, only one beverage agitating means is needed for one refrigerating enclosure.

Thus what has been described is a novel apparatus for storing, mixing, refrigerating, and dispensing beverages from either a self-contained counter top version of the present invention or from a household refrigerator door version of the present invention. It should be noted that although the description of the present invention utilizes a self-powered and a separate agitator motor 38, the fan 32 could be driven by the agitator motor 38, or vice versa.

It will thus be seen that the objects set forth above, among those made apparent from the preceding description, are efficiently attained and, since certain changes may be made in the above apparatus without departing from the scope of the invention, it is intended that all matter contained in the above description or shown in the accompanying drawings will be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described the invention what is claimed is:

1. A refrigerated fluid dispensing and agitating apparatus comprising:

A. a thermally insulated, open-ended enclosure structure incorporating:
   1. interior sidewalls defining an open-ended space therebetween to the outside, and
   2. a thermally conductive liner forming at least a portion of the interior sidewalls;

B. a fluid container interfitting within and removable from the space defined by the interior sidewalls of the enclosure structure, incorporating:
   1. a thermally insulated front plate forming a thermally and mechanically sealed compartment with said enclosure structure, and
   2. a handle portion connected to the front plate for facilitating removal of the container from the enclosure structure;

C. fluid dispensing means cooperating with the fluid container for removal of fluid therefrom;

D. refrigeration means cooperating with the thermally conductive liner for cooling the liner; and E. a removably engageable fluid agitator incorporating:
   1. a mixing blade rotatably mounted within the fluid container;
   2. first means for supplying rotational energy to the mixing blade; and
   3. second means for removably engaging the first means to the mixing blade; and F. switching means connected to said refrigeration means, said switching means incorporating a fluid container sensor, whereby said refrigeration means are de-energized when the fluid container is removed from the enclosure structure;

whereby the contents of the fluid container are refrigerated, dispensed, agitated, and stored when the fluid container is within the enclosure structure and dispensed when the fluid container is removed from the enclosure structure.

2. A refrigerated fluid dispensing and agitating apparatus as defined in claim 1, wherein the first means for supplying rotational energy to the mixing blade of the fluid agitator incorporates:

a. a shaft mounted at one end to the mixing blade,
b. a first drive cog mounted to the second end of said shaft,
c. a second drive cog removably engageable with said first drive cog, and
d. a rotational energy source engageable with said second drive cog.

3. A refrigerated fluid dispensing and agitating apparatus as defined in claim 2, wherein the second means of the fluid agitator incorporates an elongated actuator arm pivotally mounted at one end to the enclosure structure, and having its other end protruding from the enclosure structure, the second drive cog connected to the arm at one point along the arm's longitudinal axis so that movement of the arm about its pivot causes proportional movement of the second drive cog to removably engage the second drive cog with the first drive cog.

4. The refrigerated fluid dispensing and agitating apparatus as defined in claim 2, wherein the sidewalls of the fluid container extend below the bottom wall of the fluid container and where the shaft of the removably engageable fluid agitator protrudes through the bottom wall of the fluid container and where the first drive cog mounted to the second end of said shaft is located within the region defined by the extension of the fluid container sidewalls below the bottom wall of the fluid container.

5. A refrigerated fluid dispensing and agitating apparatus as defined in claim 2, wherein said second drive cog is removably housed in said enclosure structure and incorporates means for removal thereof from said enclosure structure, to facilitate cleaning of the second drive cog and the enclosure structure.

6. A refrigerated fluid dispensing and agitating apparatus as defined in claim 1, wherein said refrigeration means incorporates:

1. A housing substantially enclosing said thermally insulated enclosure structure having an air plenum adjacent to a portion of said enclosure structure with at least one air inlet and at least one air outlet,
2. a thermoelectric device having a cold region connected to the thermally conductive liner of the enclosure structure and a warm region mounted within a portion of said air plenum,
3. a direct current power supply electrically connected to the thermoelectric device, and
4. a fan communicating with the air plenum, thereby forcing air therethrough for cooling the warm region of said thermoelectric device.

7. A refrigerated fluid dispensig and agitating apparatus as defined in claim 6, further incorporating:

F. a drain structure communicating with the interior sidewalls of the enclosure structure and having a drip tray within said air plenum;

whereby moisture collected in said drip tray is evaporated by the forced air flow through the air plenum.

8. A refrigerated fluid dispensing and agitating apparatus as defined in claim 1, wherein said fluid dispensing means incorporates a valve comprising a flexible tubular section juxtaposed between a first finger portion and a second pivotal finger portion in non-aligned spacial relationship with said first finger portion, having a first distal position and a second proximal, overlap, position with respect to said first finger portion, whereby the inner sidewalls of said tubular section impinge on themselves at one place thereabout when said second finger portion is in the overlap position and where the inner sidewalls of said tubular section are in the relaxed, open, configuration for the dispensing of fluid when said second portion is in the distal position.

9. A refrigerated fluid dispensing and agitating apparatus as defined in claim 8, wherein said fluid dispensing means further incorporates a rigid tube passing through the front plate and terminating at a first end within the fluid container and at a second end with the flexible tubular section; whereby the thermally and mechanically sealed compartment is unaffected.

10. A refrigerated fluid dispensing and agitating apparatus as defined in claim 8, wherein a compression spring normally biases said first and second finger portions in the overlap position.

11. A refrigerated fluid dispensing and agitating apparatus as defined in claim 1, wherein said thermally insulated front plate is formed from a transparent material.

12. A refrigerated fluid dispensing and agitating apparatus as defined in claim 1, wherein the interior sidewalls of the open ended enclosure structure incorporate an outwardly extending closure plate frame substantially surrounding the open ended region of the enclosure structure communicating with the insulated front plate of the fluid container.

13. A refrigerated fluid dispensing and agitating apparatus as defined in claim 1, wherein said switching means further comprises a limit switch and the fluid container sensor of the switching means incorporates a push rod protruding within the interior sidewalls of the open ended enclosure structure, said push rod communicating at its other end with the limit switch to de-energize the refrigeration means when the fluid container is removed from the enclosure structure.

14. A refrigerated dispensing and agitating apparatus as defined in claim 1, further comprising:

F. at least one additional fluid container interfitting within and removable from a portion of the space defined by the interior sidewalls of the enclosure structure, incorporating:
   1. a thermally insulated front plate forming a thermally and mechanically sealed compartment with said enclosure structure and the remaining fluid containers, and
   2. a handle portion connected to the front plate for facilitating removal of the container from the enclosure structure;

whereby the removably engageable fluid agitator may alternately communicate with each of the fluid containers.

15. A beverage dispensing and agitating apparatus for use with a household refrigerator having a cut-out region in the outer door comprising:

A. a thermally insulated open-ended enclosure structure, mounted about said cut-out region, incorporating:
   1. interior sidewalls defining an open-ended space therebetween to the outside,
   2. a thermally conductive liner forming at least a portion of the interior sidewall,
   3. thermally insulated outer walls spaced from and surrounding said interior sidewalls, said outer walls defining an air plenum therewith, and comprising a refrigerated air inlet and at least one refrigerated air outlet;

B. A fluid container interfitting with and removable from the space defined by the interior sidewalls of the enclosure structure, incorporating
   1. a thermally insulated front plate forming a thermally and mechanically sealed compartment with said enclosure structure,
   2. a handle portion connected to the front plate for facilitating removal of the container from the enclosure structure;

C. fluid dispensing means cooperating with the fluid container;

D. a removably engageable fluid agitator communicating with said fluid container incorporating:
   1. a mixing blade rotatably mounted within the fluid container,
   2. first means for supplying rotational energy to the mixing blade, and
   3. second means for removably engaging the first means to the mixing blade;

E. a fan communicating with said refrigerated air inlet for forcing refrigerated air into said air plenum and out from said refrigerated air outlets; and F. switching means communicating with said fan and incorporating a fluid container sensor for causing the switching means to de-energize the fan when the fluid container is removed from the enclosure structure;

whereby the contents of the fluid container are refrigerated, dispensed, agitated, stored, and mechanically and thermally sealed when the fluid container is within the enclosure structure and dispensed and stored when the fluid container is removed from the enclosure structure, while preventing the loss of refrigerating energy from the refrigerator through the interior sidewalls of the enclosure structure when the fluid container is removed therefrom.

16. A beverage dispensing and agitating apparatus for use with a household refrigerator as defined in claim 15, wherein the first means for supplying rotational energy to the mixing blade of the fluid agitator incorporates:

a. a shaft mounted at one end to the mixing blade,
b. a first drive cog mounted to the second end of said shaft,
c. a second drive cog removably engageable with said first drive cog, and
d. a rotational energy source engageable with said second drive cog.

17. A beverage dispensing and agitating apparatus as defined in claim 16, wherein the second means of the fluid agitator incorporates an elongated actuator arm pivotally mounted at one end to the enclosure structure, and having its other end protruding from the enclosure structure, the second drive cog connected to the arm at one point along the arm's longitudinal axis so that movement of the arm about its pivot causes proportional movement of the second drive cog to removably engage the second drive cog with the first drive cog.

18. A beverage dispensing and agitating apparatus for use with a household refrigerator as defined in claim 16, wherein the sidewalls of the fluid container extend below the bottom wall of the fluid container and where the shaft of the removably engageable fluid agitator protrudes through the bottom wall of the fluid container and where the first drive cog mounted to the second end of said shaft is located within the region defined by the extension of the fluid container sidewalls below the bottom wall of the fluid container.

19. A beverage dispensing and agitating apparatus as defined in claim 15, wherein said fluid dispensing means incorporates a valve comprising a flexible tubular section juxtaposed between a first finger portion and a second pivotal finger portion in non-aligned spacial relationship with said first finger portion, having a first distal position and a second proximal, overlap, position with respect to said first finger portion, whereby the inner sidewalls of said tubular section impinge on themselves at one place thereabout when said second finger portion is in the overlap position and where the inner sidewalls of said tubular section are in the relaxed, open, configuration for the dispensing of fluid when said second portion is in the distal position.

20. A beverage dispensing and agitating apparatus as defined in claim 19, wherein a compression spring normally biases said first and second finger portions in the overlap position.

21. A fluid dispensing and agitating apparatus as defined in claim 15, wherein said switching means further comprises a limit switch and the fluid container sensor of the switching means incorporates a push rod protruding within the interior sidewalls of the open-ended enclosure structure, said push rod communicating at its other end with the limit switch to de-energize the fan when the fluid container is removed from the enclosure structure.

22. A refrigerated fluid dispensing and agitating apparatus comprising:

A. a thermally insulated open ended enclosure structure incorporating:
   1. interior sidewalls defining a space therebetween to the outside, and
   2. a thermally conductive liner forming at least a portion of the interior sidewalls;
B. a fluid container interfitting within and removable from the space defined by the interior sidewalls of the enclosure structure, incorporating:
   1. a thermally insulated front plate, said plate forming a thermally and mechanically sealed compartment with said enclosure structure, and
   2. a handle portion connected to the front plate for facilitating removal of the container from the enclosure structure;
C. fluid dispensing means cooperating with the fluid container for removal of fluid therefrom;
D. refrigeration means cooperating with the thermally conductive liner for cooling the liner;
E. a removably engageable fluid agitator incorporating:
   1. a shaft protruding through a wall of said fluid container,
   2. a mixing blade mounted to a first end of said shaft,
   3. a first drive cog mounted to the second end of said shaft,
   4. a second drive cog removably engageable with said first drive cog,
   5. means for engaging said second drive cog with said first drive cog, and
   6. a rotational energy source engageable with said second drive cog;
F. Switching means connected to said refrigeration means, said switching means incorporating a fluid container sensor, whereby said refrigeration means are de-energized when the fluid container is removed from the enclosure structure; and
G. A drain structure communicating with the interior sidewalls of the enclosure structure and having a drip tray for collection of moisture from the thermally conductive liner of the enclosure structure; whereby the contents of the fluid container are refrigerated, dispensed, agitated, and stored when the fluid container is within the enclosure structure and dispensed when the fluid container is removed from the enclosure structure while minimizing refrigeration loss when the fluid container is removed from the enclosure structure.

23. A refrigerated beverage dispensing and agitating apparatus comprising:

A. a thermally insulated, open-ended enclosure structure incorporating:
   1. interior sidewalls defining a space therebetween to the outside,
   2. a thermally conductive liner forming at least a portion of the interior frame substantially surrounding the open-ended region of the enclosure structure;
B. a fluid container interfitting within and removable from the space defined by the interior sidewalls of the enclosure structure, incorporating
   1. a thermally insulated front plate, said plate forming a thermally and mechanically sealed compartment with the closure plate frame of said enclosure structure, and
   2. a handle portion connected to the front plate for facilitating removal of the container from the enclosure structure;
C. fluid dispensing means cooperating with the fluid container;
D. refrigeration means incorporating:
   1. a housing substantially enclosing said thermally insulated enclosure structure having an air plenum adjacent to a portion of said enclosure structure with at least one air inlet and at least one air outlet, 2. a thermoelectric device having a cold region connected to the thermally conductive liner of the enclosed structure and a warm region mounted within a portion of said air plenum,
3. a direct current power supply electrically connected to the thermoelectric device, and
4. a fan communicating with the air plenum thereby forcing air therethrough for cooling the warm region of said thermoelectric device;

E. switching means connected to the thermoelectric device, said switching means incorporating a fluid container sensor communicating with the space defined by the interior sidewalls of the enclosure structure whereby said thermoelectric device is de-energized when the fluid container is removed from said space;

F. a removably engageable beverage agitator incorporating:
1. a shaft protruding through the bottom wall of said beverage container,
2. a mixing blade mounted in a substantially perpendicular configuration to a first end of said shaft,
3. a first drive cog mounted to the second end of said shaft,
4. a second drive cog removably engageable with said first drive cog and passing through the bottom interior sidewall of the enclosure structure,
5. means for engaging said second drive cog with said first drive cog, and
6. a rotational energy source engageable with said second drive cog; and G. A drain structure communicating with the interior sidewalls of the enclosure structure and having a drip tray within said air plenum, for collection of moisture from said sidewalls and for evaporation of the collected moisture by the forced air flow through the air plenum;

whereby the contents of the beverage container are refrigerated, dispensed, agitated, and stored when the beverage container is within the space defined by the interior sidewalls of the enclosure structure and where the contents of the beverage container are dispensed when the beverage container is removed from said space and where refrigeration loss is minimized when said beverage container is removed from said space and where moisture formed on said thermally conductive liner is collected and evaporated away from the interior sidewalls of the enclosure structure.

* * * * *